US006702371B2

(12) United States Patent
Zheng

(10) Patent No.: US 6,702,371 B2
(45) Date of Patent: Mar. 9, 2004

(54) FOLDABLE CHAIR WITH DETACHABLE SEAT ARRANGEMENT

(76) Inventor: Edward Zheng, 1736 Wright Ave., La Verne, CA (US) 91750

( * ) Notice: Subject to any disclaimer, the term of this patent is extended or adjusted under 35 U.S.C. 154(b) by 0 days.

(21) Appl. No.: 10/178,686

(22) Filed: Jun. 25, 2002

(65) Prior Publication Data

US 2003/0234561 A1 Dec. 25, 2003

(51) Int. Cl.[7] ..... A47C 4/00
(52) U.S. Cl. ..... 297/16.2; 297/16.1; 297/45
(58) Field of Search ..... 297/16.1, 16.2, 297/42, 59, 45, 218.1, 218.3, 218.5, 463.1, 463.2

(56) References Cited

U.S. PATENT DOCUMENTS 2,723,712 A * 11/1955 Yellen ..... 297/440.11
4,421,356 A * 12/1983 Singer ..... 297/16.1
5,984,406 A * 11/1999 Lee ..... 297/16.2
6,045,177 A * 4/2000 Grace ..... 297/45
6,170,907 B1 * 1/2001 Tsai ..... 297/16.1
6,179,374 B1 * 1/2001 Tang ..... 297/45
6,322,138 B1 * 11/2001 Tang ..... 297/45
6,332,646 B1 * 12/2001 Tseng ..... 297/16.1
6,447,057 B1 * 9/2002 Chen ..... 297/16.2

* cited by examiner

*Primary Examiner*—Peter M. Cuomo
*Assistant Examiner*—Erika Garrett
(74) *Attorney, Agent, or Firm*—Raymond Y. Chan; David and Raymond Patent Group

(57) ABSTRACT

A foldable chair includes a foldable chair frame, a seat frame, and a detachable seat arrangement. The seat frame includes a fabric supporting frame and a seat fabric supported thereon. The fabric supporting frame includes a pair of semi-circular seat supporting bars pivotally and foldably connected together to form a complete fabric supporting frame. The detachable seat arrangement includes a pair of fabric frame holders securely mounted on the upper attaching portions of the rear supporting legs respectively, and a pair of securing members provided at the seat portion of the seat fabric for detachably mounting the fabric supporting frame onto the front supporting frame. Moreover, each of the fabric frame holders has an engaging slot formed on an upper portion thereof for engaging with the frame connecting portions of the fabric supporting frame.

19 Claims, 7 Drawing Sheets

FOLDABLE CHAIR WITH DETACHABLE SEAT ARRANGEMENT

BACKGROUND OF THE PRESENT INVENTION

1. Field of Invention

The present invention relates to a chair, and more particularly to a foldable chair with detachable seat arrangement which is capable of supporting the weight of the users.

2. Description of Related Arts

Foldable chairs are widely used all over the world. People often use foldable chair in outdoors environment such as in beaches or in campsites in that they are portable and usually foldable.

Referring to FIG. 1 of the drawings, usually a conventional foldable chair comprises a chair frame A1 and a seat fabric B1. The chair frame A1 comprises a plurality of construction bars C1 pivotally connected together to form a back supporting frame A11 and a seat supporting frame A12 for supporting the seat fabric B1. The seat supporting frame comprises a front pair, a back pair, and two pairs of construction bars C1, wherein each pair of construction bars are pivotally connected together to form a pivotal 'X' structure.

The seat fabric B1 has a seat portion B11 and a back supporting potion B12, wherein the seat fabric B1 is slidably and suspendedly attached onto the chair frame A1 so as to provide a seat to the users.

However, such a conventional foldable chair possesses some significant drawbacks. First of all, since the fabric seat B1 is suspendedly supported by the chair frame, and the fabric by itself is soft and can be folded or squeezed into irregular shape, the seat fabric may not be substantially supported by the chair frame A1 due to small supporting surface area. From simple physical analysis, one can easily expect that when a person sits onto the seat portion of the seat fabric B1, the seat fabric B1 will easily be stretched toward the central part of the seat portion and the person sitting thereon will tend to plunge into the central part of the seat portion. This usually makes the person sitting thereon difficult to move and feel uncomfortable or insecure.

In terms of the ways in which the seat fabric is supported, as shown in FIG. 1, only point support is provided to the seat fabric B1. The seat portion of the seat fabric is supported by a pair of supporting joints A13 positioned near the front side corners of the seat fabric. When the person sits onto the seat fabric B1, the weight of the user tries to pull the edges of the seat fabric B1 toward the central portion thereof, and therefore stress will be induced and substantially concentrated at the joints that suspendedly support the seat fabric B1. As a result, after a considerable period of time, the joints may be distorted or more seriously, broken, and this can bring disastrous consequence to the user.

Moreover, the seat fabric B1 is permanently attached onto the chair frame A1. Because the foldable chair is usually used in outdoors environment, after a period of time, the seat fabric B1 will be dirty and need cleaning. However, sometimes the user is hard or even unable to detach the seat fabric for cleaning purpose.

Last but not least, for the chair to be compactly foldable, one shouldn't attach any bulky accessory, such as a seating cushion onto the chair. Therefore, conventionally, the seating portion of the chair is usually made of fabric and in simple structure, thus making the chair uncomfortable. From another point's of view, the seat fabric B1 of the foldable chair plays an important role for the compactness thereof. Thus, in other words, the simpler the seat fabric is, the more compact the chair can fold. A detachable seat may be needed to solve this problem.

SUMMARY OF THE PRESENT INVENTION

A main object of the present invention is to provide a foldable chair with detachable seat arrangement, wherein the user's body can be substantially supported so that the foldable chair is more comfortable to the user as compare with conventional foldable chairs.

Another object of the present invention is to provide a foldable chair with detachable seat arrangement wherein line support is provided for supporting the seat fabric, so as to minimize the stretching and distortion of the seat fabric when the user is sat onto the foldable chair.

Another object of the present invention is to provide a foldable chair with detachable seat arrangement wherein the seat fabric can be detached from and attached onto the chair frame without involving any complicated mechanical procedure.

Another object of the present invention is to provide a foldable chair with detachable seat arrangement wherein the chair frame and the seat supporting frame are capable of individually folding into compact size so as to facilitate easy and convenient carrying and storage.

Another object of the present invention is to provide a foldable chair with detachable seat arrangement which does not require to significantly alter the original structure and shape of a conventional foldable chair, so as to minimize the manufacturing and administrative cost of the present invention.

Accordingly, in order to accomplish the above objects, the present invention provides a foldable chair comprising:

- a chair frame which comprises:
  - a front supporting frame which comprises a plurality of front frame legs pivotally coupled with each other to form a pivotal 'X' structure;
  - a pair of side supporting frames, wherein each side supporting frame comprises a first and a second side frame leg pivotally coupled with each other to form a pivotal 'X' structure; and
  - a back supporting frame which comprises a plurality of back frame legs pivotally coupled with each other to form a pivotal 'X' structure, and a plurality of rear supporting legs, wherein each of the rear supporting legs has an upper attaching portion;
  - a pair of front frame joints pivotally connecting two upper end portions of the front frame legs and two upper end portions of the first side frame legs respectively; and
  - a pair of back frame joints pivotally connecting two upper end portions of the back frame legs and two upper ends portions of the second side frame legs respectively, wherein the pair of rear supporting legs are upwardly extended through the pair of back frame joints respectively;
- a seat frame which comprises:
  - a fabric supporting frame which comprises at least a seat supporting bar to define a seat portion, a back portion and a central opening of the fabric supporting frame,
  - a seat fabric which has a side edge portion substantially supported by the fabric supporting frame; and
  - a detachable seat arrangement which comprises:

a plurality of fabric frame holders provided at the upper attaching portions of the rear supporting frames respectively for detachably mounting the fabric supporting frame on the back supporting frame; and a pair of securing members provided on the seat frame for detachably mounting the fabric supporting frame onto the front supporting frame, so as to secure the seat frame on the chair frame in a detachable manner.

DETAILED DESCRIPTION OF THE PREFERRED EMBODIMENT

Figure 1:
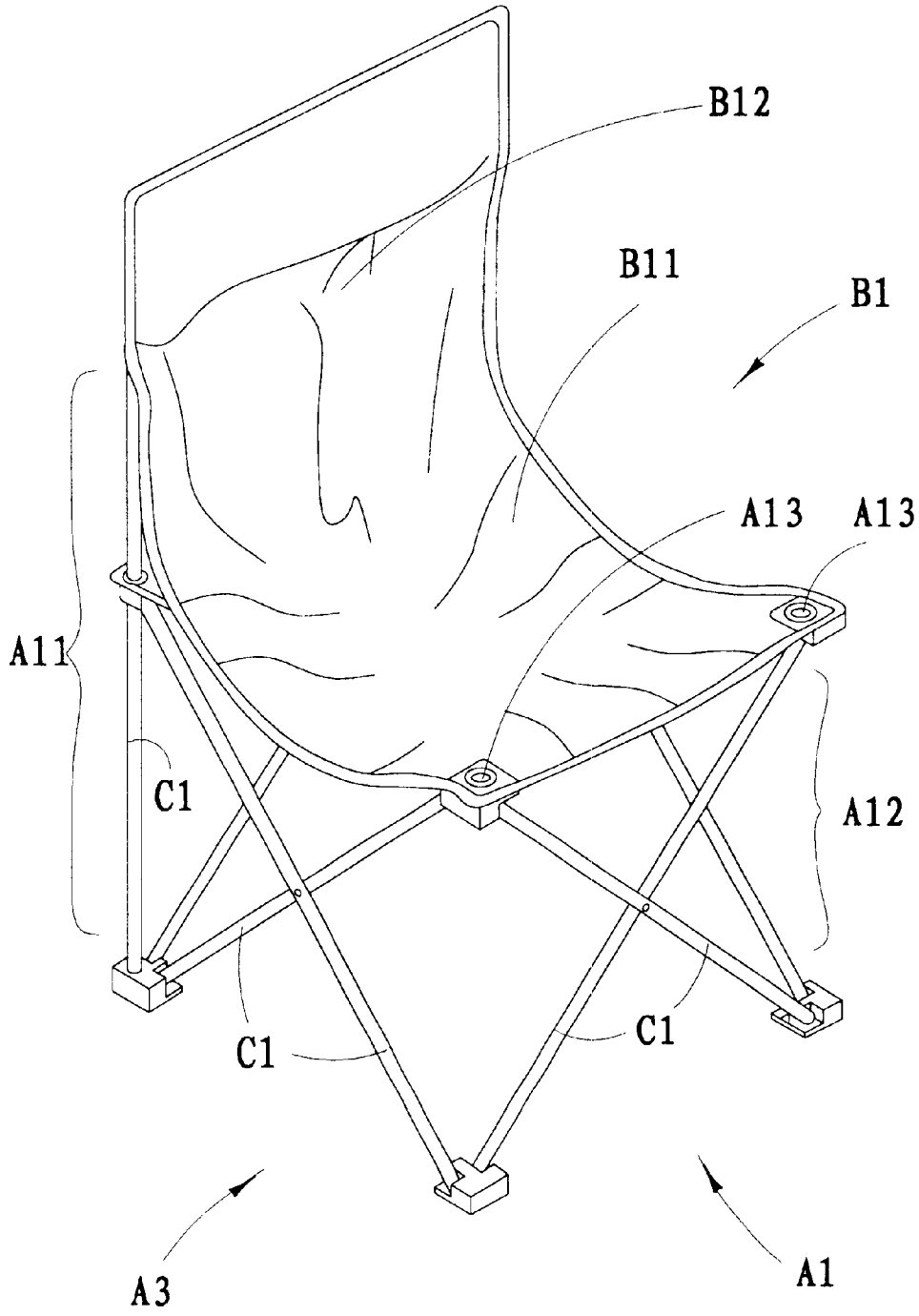
FIG. 1 PRIOR ART
FIG. 1 is a perspective view of a conventional foldable chair.
Figure 2:
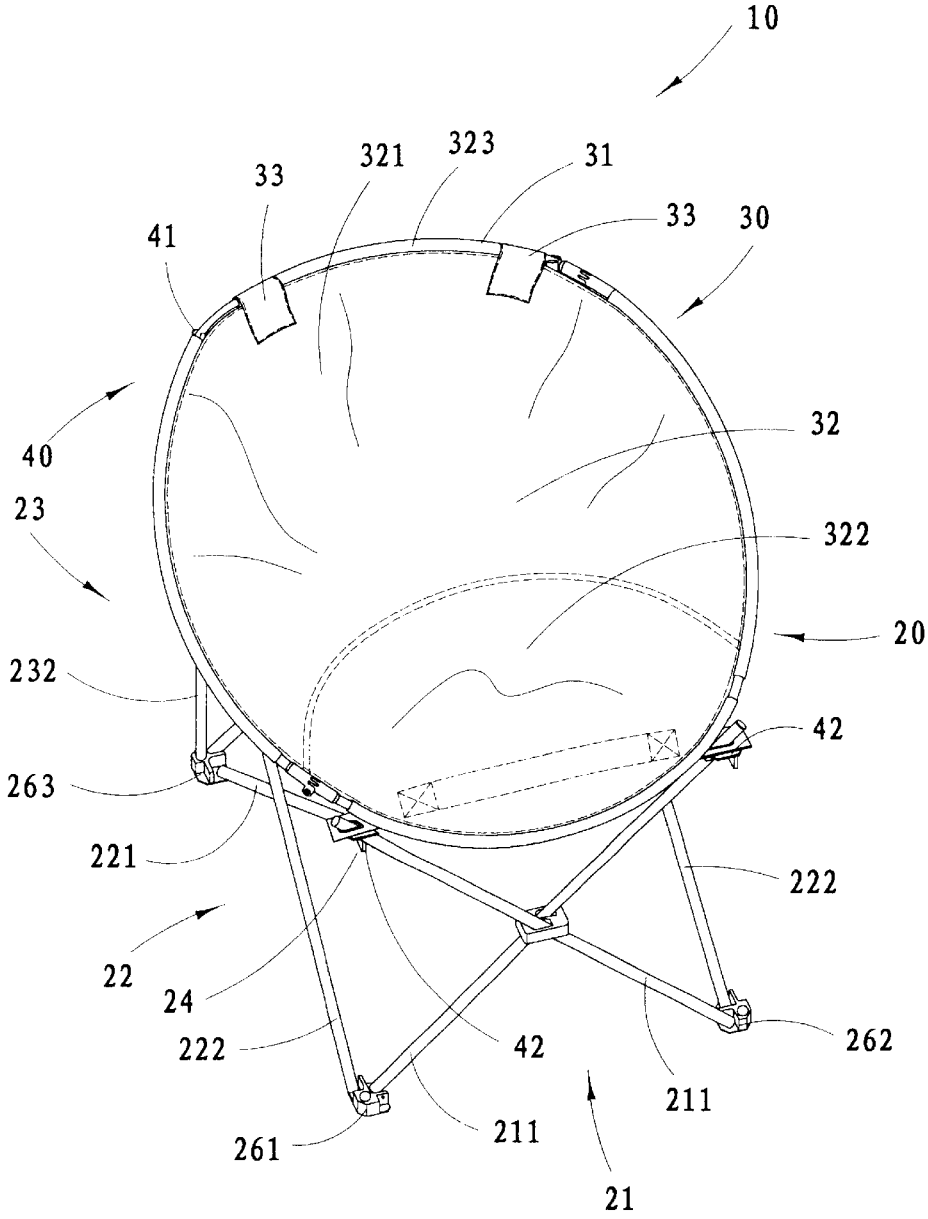
FIG. 2 is a perspective view of a foldable chair with detachable seat arrangement according to a first preferred embodiment of the present invention.
Figure 3:
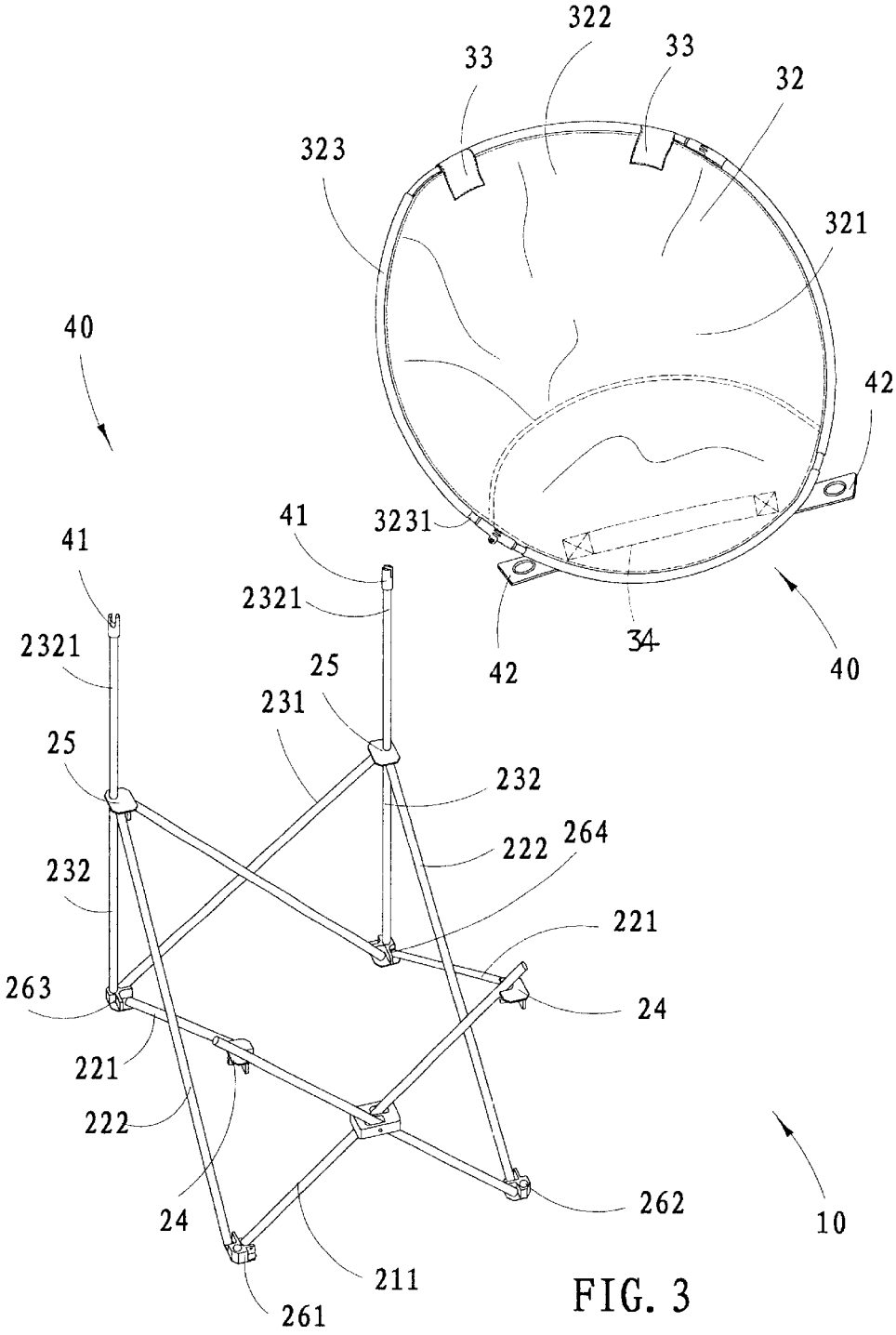
FIG. 3 is an exploded perspective view of the foldable chair with detachable seat arrangment according to the first preferred embodiment of the present invention, illustrating that the seat frame is detached from the chair frame.

Referring to FIGS. 2 to 3 of the drawings, a foldable chair 10 with detachable seat arrangement 40 according to a first preferred embodiment of the present invention is illustrated. According to the first preferred embodiment of the present invention, the foldable chair 10 comprises a chair frame 20, a seat frame 30 inclinedly supported by the chair frame 20, and a detachable seat arrangement 40.

The chair frame 20 comprises a front supporting frame 21, a pair of side supporting frames 22, and a back supporting frame 23. The front supporting frame 21 comprises a plurality of front frame legs 211 pivotally coupled with each other to form a pivotal 'X' structure. Each of the side supporting frames 22 comprises a first and a second side frame leg 221, 222 pivotally coupled with each other to form a pivotal 'X' structure. The back supporting frame 23 comprises a pair of back frame legs 231 pivotally coupled with each other to form a pivotal 'X' structure, and a pair of rear supporting legs 232 each having an upper attaching portion 2321.

The chair frame 20 further comprises a pair of front frame joints 24 and a pair of back frame joints 25, wherein the front frame joints 24 are pivotally connected with two upper end portions of the two front frame legs 211 and two upper end portions of the first side frame legs 221 respectively, and the back frame joints 25 are pivotally connected with the two upper end portions of the back frame legs 231 and the upper end portions of the second side frame legs 222 respectively.

The chair frame 20 further comprises four base joints 261, 262, 263, 264. The first and the second base joint 261, 262 are pivotally connected with the lower end portions of the front frame legs 211 and the lower end portions of the first side frame legs 221 respectively, whereas the third and the fourth base joints 263, 264 are pivotally connected with the lower end portions of the back frame legs 231 and the lower end portions of the second side frame legs 222 respectively. Moreover, the lower end portions of the rear supporting legs 232 are connected to the third and the fourth base joints 263, 264 respectively.

The pair of rear supporting legs 232 is upwardly extended from the third and the fourth base joints 263, 264 and slidably pass through the pair of back frame joints 25 respectively so as to provide support to the seat frame 30 and the detachable seat arrangement 40.

The seat frame 30 comprises a fabric supporting frame 31 and a seat fabric 32 supported thereon. According to the first preferred embodiment of the present invention, the fabric supporting frame 31 comprises a pair of semi-circular seat supporting bars 311 pivotally and foldably connected together in an end-to-end manner so as to form a complete fabric supporting frame 31 having a fabric supporting portion 312 and a frame connecting portion 313. Thus, the fabric supporting frame 31 is circular in shape having a central opening 314 for supporting a main portion of the seat fabric 32 therein.

The seat fabric 32 is supported by the fabric supporting frame in such a manner that an edge portion of the seat fabric 32 is mounted along the fabric supporting portion 312 of the fabric supporting frame 31. Thus, the seat fabric 32 is substantially supported by the fabric supporting frame 31. Moreover, the above structural arrangement provides line support to the seat fabric 32 so that any downward loading exerted thereon, such as the weights of the users, is capable of being evenly distributed along the seat supporting bars 311.

The edge portion of the seat fabric 32 has two tubular and elongated holding sleeves 323 formed thereon, wherein each of the holding sleeve 323 has an elongated receiving cavity 3231 for one of the seat supporting bars 311 passing through and being received therein.

Accordingly, the fabric supporting portion 312 of the fabric supporting frame 31 is the portion of the seat supporting bar 311 that is received inside the holding sleeves 323. Similarly, the frame connecting portion 313 is the portion of the seat supporting bar 311 that is not received inside the holding sleeves 323.

With the edge portion substantially supported by the fabric supporting frame 31, a main portion of the seat fabric 32 is suspendedly supported inside the central opening 314. The main potion of the seat fabric 32 is divided into a seat portion 321 for mainly supporting the user's hip and thigh, and a back supporting potion 322 for mainly supporting the user's trunk.

Figure 4:
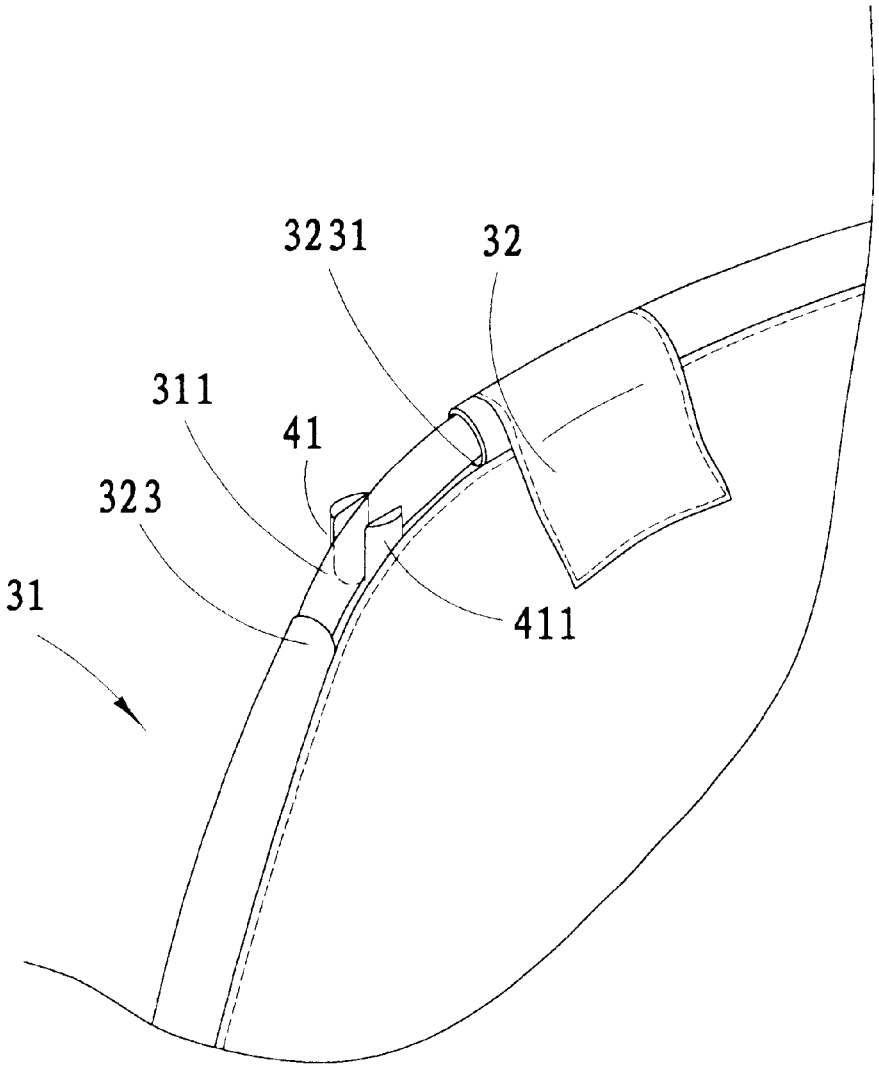
FIG. 4 is a perspective view of the fabric frame holder of the foldable chair according to the above first preferred embodiment of the present invention.

Referring to FIG. 4 of the drawings, the detachable seat arrangement 40 is comprises a pair of fabric frame holders 41 securely mounted on the upper attaching portions 2321 of the rear supporting legs 232 respectively, and a pair of securing members 42 provided at the seat portion 321 of the seat fabric 32 for detachably mounting the fabric supporting frame 31 onto the front supporting frame 21.

Each of the fabric frame holders 41 has an top inclined surface and two side walls upwardly extended therefrom to define an engaging slot 411 for engaging with the frame connecting portions 313 of the fabric supporting frame 31. The orientation of the engaging slots 411 are substantially aligned with the frame connecting portions 313 of the fabric supporting frame 31 respectively, so that they are capable of fittedly engaging with the engaging slots 411 formed on the fabric frame holders 41 respectively.

Figure 5:
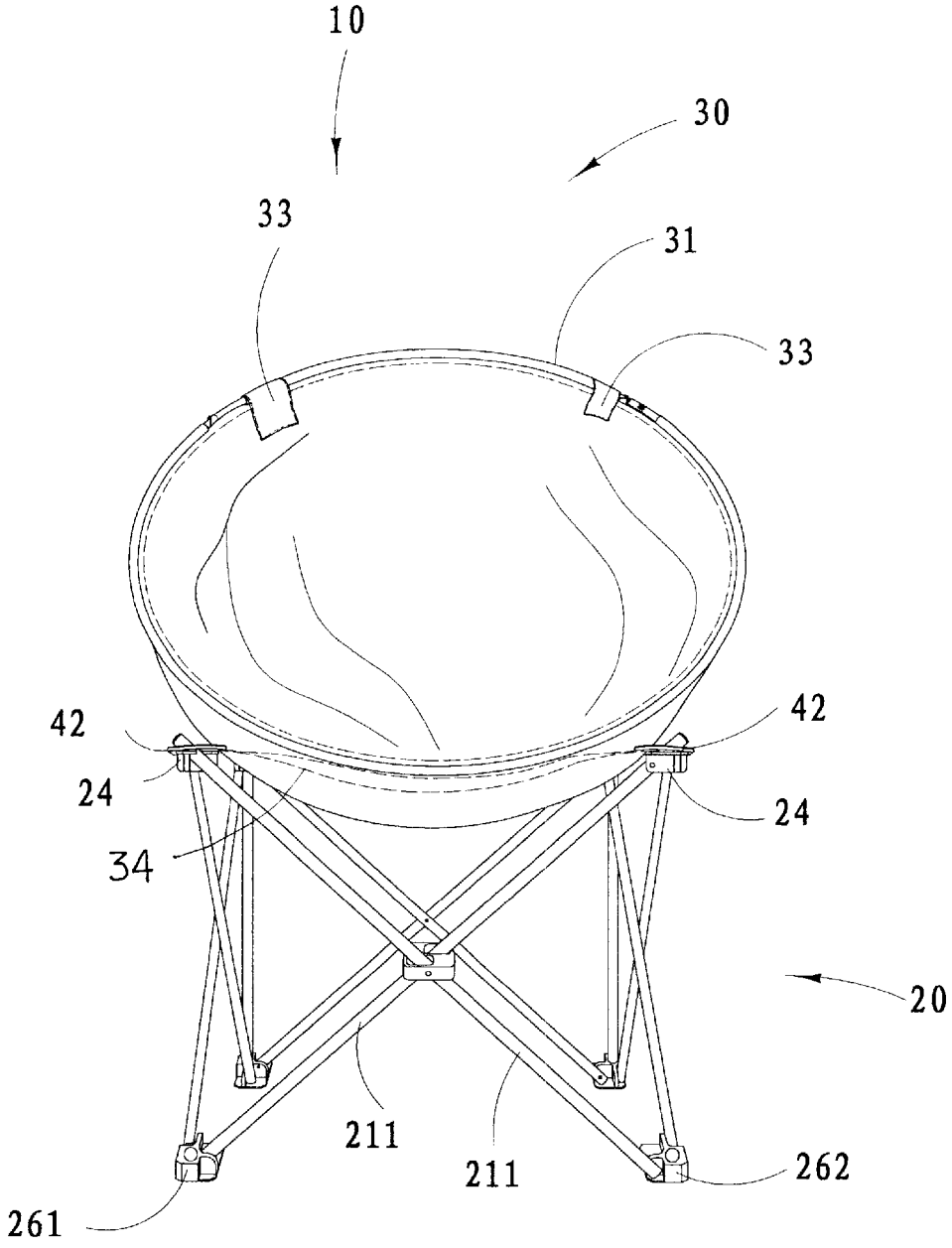
FIG. 5 is a front view of the foldable chair according to the above first preferred embodiment of the present invention, illustrating that the seat frame is mounted onto the chair frame by means of the securing members.

Referring to FIG. 5 of the drawings, the front frame legs 211 are upwardly protruded through the two front frame joints 24 to form two respective protruding portions of the front frame legs 211. According to the first preferred embodiment, the securing members 42 are essentially two fabric-made securing wings securely attached on the bottom surface of the seat fabric 32, wherein each of the fabric-made securing wings has a through securing ring 421 formed thereon. The protruding portions of the front frame legs 211 are arranged to pass through the through securing rings 421 respectively so as to detachably hold the seat portion 321 of the seat fabric 32 in position. In other words, the fabric supporting frame 31 are securely held in position by the pair of the fabric frame holders 41 and the pair of the securing members 42, wherein the fabric frame holders 41 keep the back supporting portion 322 of the seat fabric 32 in position and the securing members 42 keep the seat portion 321 of the seat fabric 32 in position.

It is worth to mention that the height of the frame supporting holders 41 should be greater than the height of the pair of the protruding portions of the front frame legs 211 so that the seat frame 30 is inclinedly supported by the chair frame 20.

Referring to FIG. 3 of the drawings, the seat frame 30 further comprises a plurality of reinforcing holders 33 provided on the edge portion of the seat fabric 32 for further enhancing the mounting strength between the seat fabric 32 and the fabric supporting frame 31. Each of the reinforcing holders 33 has two ends affixed onto the top and bottom surface of the seat fabric 32 respectively so as to define a holding cavity 331 for holding one of the seat supporting bars 311 and the edge portion of the seat fabric 32.

Referring to the FIG. 5 of the drawings, the seat frame 30 further comprises a strengthening member 34 provided at the bottom surface of the seat fabric 32 and connecting the two securing members 42. The strengthening member 34 is fabric-made and affixed to bottom surface of the seat fabric 32 so as to provide additional support to the seat portion 321 of the seat fabric 32, so that the user's hip and thigh will feel more comfortable and secure when he/she sits on the foldable chair of the present invention.

To attach the seat frame 30 onto the chair frame 20, a user has first to unfold the chair frame 20, and unfold the pair of seat supporting bars 311 into a complete circular fabric supporting frame 31. Then, the user has to mount the seat frame 30 into the chair frame 20 by engaging the frame connecting portion 313 of the fabric supporting frame 31 with the engaging slots 411 of the fabric frame holders 41, and affixing the pair of securing members 42 to the protruding portions of the front frame legs 211 through the through securing rings 421 respectively. Conversely, to detach the seat frame 30 from the chair frame 20, the user has to detach the pair of securing members 42 from the front frame legs 211, and then to disengage the fabric supporting frame 31 from the fabric frame holders 41. Finally, the user should fold up the foldable chair frame 20 as well as the fabric supporting frame 31.

Note that by detaching the seat frame 30 from the foldable chair frame 20, the users of the present invention can be able to carry the foldable chair 10 conveniently in that the seat frame 30 as well as the chair frame 20 are capable of being folded into a compact size.

Also, it is important to remark that the fabric supporting frame 31 can be constructed to any reasonable shape such as a rectangular shape or a square shape, instead of the circular shape as mentioned above, as long as the fabric supporting frame 31 is capable of providing line support to the seat fabric mounted thereon.

Figure 6:
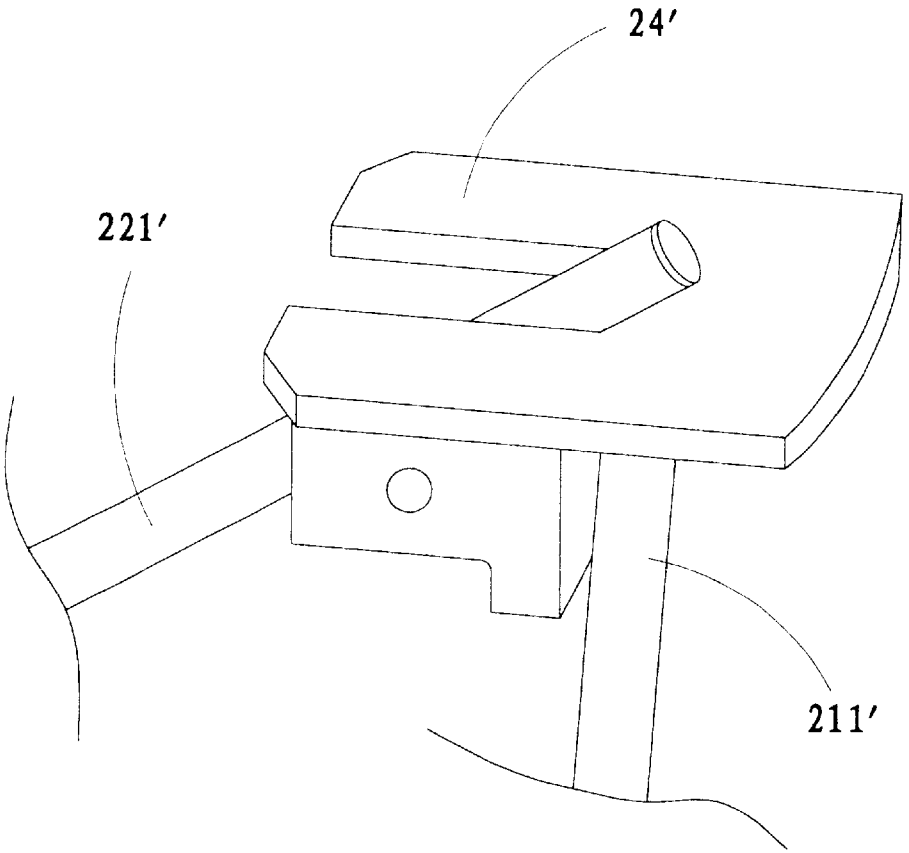
FIG 6 is a first alternative mode of the detachable seat arrangement of the foldable chair according to the above first preferred embodiment of the present invention.

Referring to FIG. 6 of the drawings, an alternative mode of the detachable seat arrangement 40' according to the first preferred embodiment of the present invention is illustrated. According to the first alternative mode, instead of penetrating the front frame joints 24 by the front frame legs 211 respectively, the first side frame legs 221' are upwardly extended from the pair of front frame joints 24' to define the two protruding portions of the two first side frame legs 221' respectively. The securing members 42' affixed on the seat fabric 32' are then arranged for mounting onto the protruding portions of the first side frame legs respectively, as shown in FIG. 8.

Figure 7:
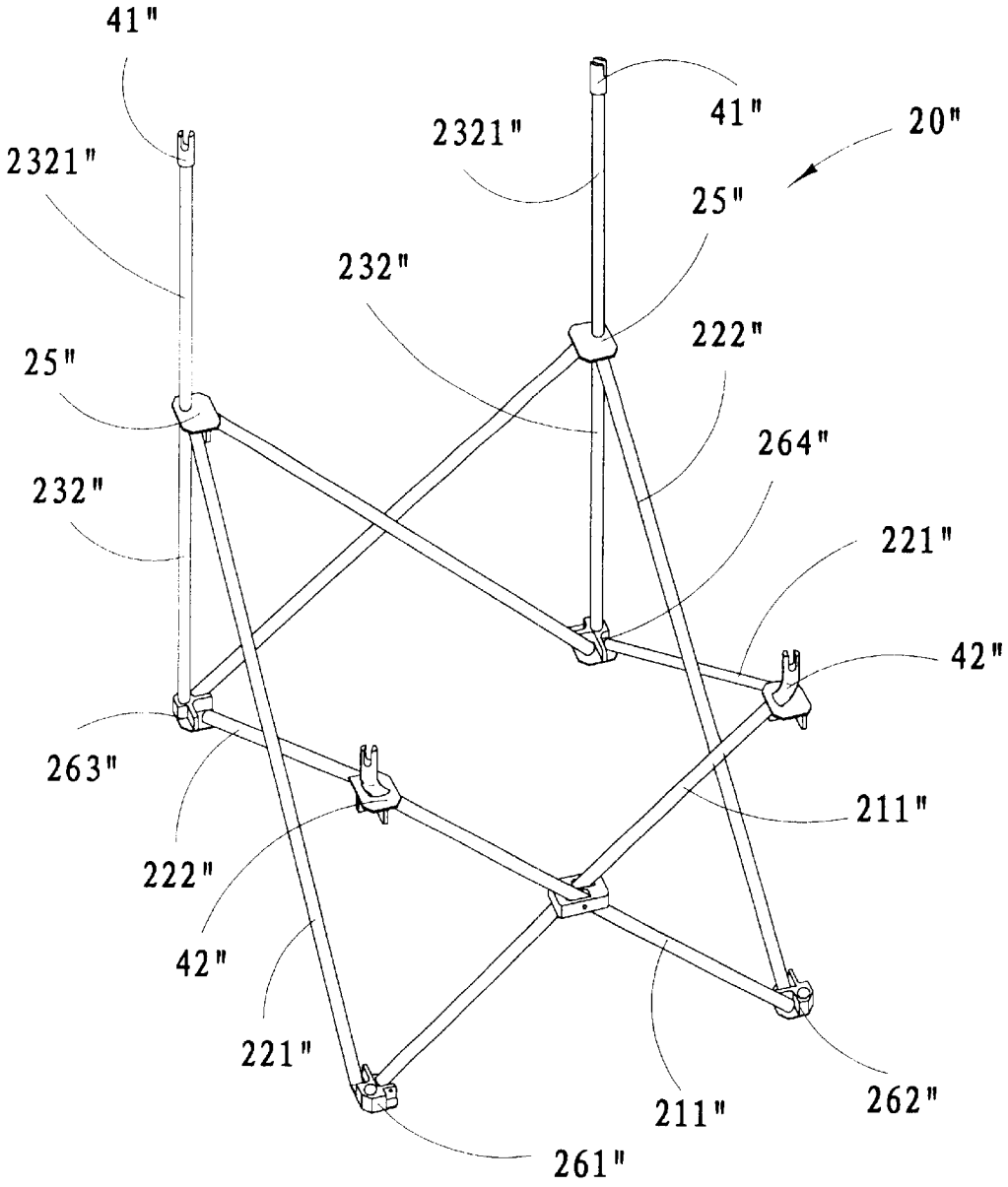
FIG. 7 is a second alternative mode of the detachable seat arrangement of the foldable chair according to the above first preferred embodiment of the present invention.

Referring to FIG. 7 of the drawings, a second alternative mode of the detachable seat arrangement 40" according to the first preferred embodiment of the present invention is illustrated. The second alternative mode is similar to that of the first preferred embodiment except the detachable seat arrangement 40. According to the second alternative mode, each of the securing members 42" comprises a seat securing holder 44" having one end mounted onto the protruding portions of the front frame legs 211" and another end mounted on the fabric supporting frame 31". Each of the seat securing holders 44" has an holding slot 441" formed thereon for detachably engaging with the seat supporting bars 311" of the fabric supporting frame 31". The orientation of the holding slot 441" is made to well-aligned with the seat supporting bars 311" for fittedly engaging the securing holders 44" onto the seat frame 30". Accordingly, the fabric supporting frame 31" is capable of engaging and disengaging with the fabric frame holders 41" and the seat supporting holders 44", so as to detachably mount the seat frame 30" on to the chair frame 20".

It is worth to mention that in addition to the seat fabric 30 for seating purpose, one can freely put a foldable cushion on top of the seat fabric in order to enhance the comfort of the foldable chair 10 of the present invention.

What is claimed is:

1. A foldable chair, comprising:

a chair frame which comprises:

a front supporting frame which comprises a plurality of front frame legs pivotally coupled with each other to form a pivotal 'X' structure;

a pair of side supporting frames, wherein each side supporting frame comprises a first and a second side frame leg pivotally coupled with each other to form a pivotal 'X' structure; and a back supporting frame which comprises a plurality of back frame legs pivotally coupled with each other to form a pivotal 'X' structure, and a plurality of rear supporting legs, wherein each of said rear supporting legs has an upper attaching portion;

a pair of front frame joints pivotally connecting two upper end portions of said front frame legs and two upper end portions of said first side frame legs respectively; and a pair of back frame joints pivotally connecting two upper end portions of said back frame legs and two upper end portions of said second side frame legs respectively, wherein said pair of rear supporting legs are upwardly extended through said pair of back frame joints respectively;

a seat frame which comprises:

a fabric supporting frame which comprises at least a first seat supporting bar to define a central opening of said fabric supporting frame, said fabric supporting frame having at least a frame connecting portion and a fabric supporting portion;

a seat fabric which has a side edge portion substantially supported by said fabric supporting portion of said fabric supporting frame, and a main portion supported inside said central opening of said fabric supporting frame, said main portion being divided into a seat portion and a back supporting portion; and a detachable seat arrangement which comprises:

a plurality of fabric frame holders provided at said upper attaching portions of said rear supporting frames respectively for detachably mounting said fabric supporting frame on said back supporting frame, wherein each of said fabric frame holders has top inclined surface and a pair of side walls upwardly extended therefrom to define an engaging slot for engaging with said frame connecting portion of said fabric supporting frame, said engaging slots having orientations substantially aligned with said frame connecting portions of said fabric supporting frame respectively, so that said seat supporting frame is capable of fittedly engaging with said engaging slots formed on said fabric frame holders respectively so as to hold said back supporting portion of said seat fabric in position; and a pair of securing members provided on said seat frame for detachably mounting said fabric supporting frame onto said front supporting frame, so as to secure said seat frame on said chair frame in a detachable manner.

2. The foldable chair, as recited in claim 1, wherein said front frame legs are upwardly extended through said front frame joints respectively to form two protruding portions of said front frame legs respectively, and wherein each of said securing members comprises a fabric-made securing wing securely attached on a bottom surface of said seat fabric, wherein each of said wings has a through securing ring formed thereon for said protruding portions of said front frame legs passing therethrough so as to detachably hold said seat portion of said seat fabric in position.

3. The foldable chair, as recited in claim 2, wherein said first seat supporting bar is semi-circular in shape, and wherein said fabric supporting frame further comprises a second semi-circular seat supporting bar pivotally and foldably connected to said first seat supporting bar in an end-to-end manner so as to form a complete circular fabric supporting frame.

4. The foldable chair, as recited in claim 2, wherein said edge portion of said seat fabric has two tubular and elongated holding sleeves formed thereon, wherein each of said holding sleeves has an elongated receiving cavity for said fabric supporting portion of said seat supporting frame to pass through and to be received therein so as to provide line support to said seat fabric.

5. The foldable chair, as recited in claim 3, wherein said edge portion of said seat fabric has two tubular and elongated holding sleeves formed thereon, wherein each of said holding sleeves has an elongated receiving cavity for said fabric supporting portion of said seat supporting frame to pass through and to be received therein so as to provide line support to said seat fabric.

6. The foldable chair, as recited in claim 4, wherein said seat frame further comprises a plurality of reinforcing holders provided on said edge portion of said seat fabric for further enhancing a mounting strength between said seat fabric and said fabric supporting frame, each of said reinforcing holders having two ends affixed onto a top and said bottom surface of said seat fabric respectively so as to define a holding cavity for holding said seat supporting bar and said edge portion of said seat fabric.

7. The foldable chair, as recited in claim 5, wherein said seat frame further comprises a plurality of reinforcing holders provided on said edge portion of said seat fabric for further enhancing a mounting strength between said seat fabric and said fabric supporting frame, each of said reinforcing holders having two ends affixed onto a top and said bottom surface of said seat fabric respectively so as to define a holding cavity for holding said seat supporting bar and said edge portion of said seat fabric.

8. The foldable chair, as recited in claim 6, wherein said seat frame further comprises a fabric-made strengthening member provided at said bottom surface of said seat fabric and connecting said two securing members for providing additional support to said seat portion of said seat fabric apart from that provided by said seat supporting bar.

9. The foldable chair, as recited in claim 7, wherein said seat frame further comprises a fabric-made strengthening member provided at said bottom surface of said seat fabric and connecting said two securing members for providing additional support to said seat portion of said seat fabric apart from that provided by said seat supporting bar.

10. The foldable chair, as recited in claim 1, wherein said first side frame legs are upwardly extended through said front frame joints respectively to form two protruding portions of said first side frame legs respectively, and wherein each of said securing members comprises a fabric-made securing wing securely attached on a bottom surface of said seat fabric, wherein each of said wings has a through securing ring formed thereon for said protruding portions of said first side frame legs passing therethrough so as to detachably hold said seat portion of said seat fabric in position.

11. The foldable chair, as recited in claim 10, wherein said first seat supporting bar is semi-circular in shape, and wherein said fabric supporting frame further comprises a second semi-circular seat supporting bar pivotally and foldably connected to said first seat supporting bar in an end-to-end manner so as to form a complete circular fabric supporting frame.

12. The foldable chair, as recited in claim 11, wherein said edge portion of said seat fabric has two tubular and elongated holding sleeves formed thereon, wherein each of said holding sleeves has an elongated receiving cavity for said fabric supporting portion of said seat supporting bar to pass through and to be received therein so as to provide line support to said seat fabric.

13. The foldable chair, as recited in claim 12, wherein said seat frame further comprises a plurality of reinforcing holders provided on said edge portion of said seat fabric for further enhancing a mounting strength between said seat fabric and said fabric supporting frame, each of said reinforcing holders having two ends affixed onto a top and said bottom surface of said seat fabric respectively so as to define a holding cavity for holding said seat supporting bar and said edge portion of said seat fabric.

14. The foldable chair, as recited in claim 13, wherein said seat frame further comprises a fabric-made strengthening member provided at said bottom surface of said seat fabric and connecting said two securing members for providing additional support to said seat portion of said seat fabric apart from said seat supporting bar apart from that provided by said seat supporting bar.

15. The foldable chair, as recited in claim 1, wherein said front frame legs are upwardly extended through said front frame joints respectively to form two protruding portions of said front frame legs respectively, and wherein each of said securing members comprises a seat securing holder having a holding slot formed thereon for fittedly engaging with said seat supporting bar, said securing holders being mounted on said protruding portion of said front frame legs respectively.

16. The foldable chair, as recited in claim 15, wherein said first seat supporting bar is semi-circular in shape, and wherein said fabric supporting frame further comprises a second semi-circular seat supporting bar pivotally and foldably connected to said first seat supporting bar so as to form a complete circular fabric supporting frame.

17. The foldable chair, as recited in claim 16, wherein said edge portion of said seat fabric has two tubular and elongated holding sleeves formed thereon, wherein each of said holding sleeves has an elongated receiving cavity for said fabric supporting portion of said seat supporting frame to pass through and to be received therein so as to provide line support to said seat fabric.

18. The foldable chair, as recited in claim 17, wherein said seat frame further comprises a plurality of reinforcing holders provided on said edge portion of said seat fabric for further enhancing a mounting strength between said seat fabric and said fabric supporting frame, each of said reinforcing holders having two ends affixed onto a top and said bottom surface of said seat fabric respectively so as to define a holding cavity for holding said seat supporting bar and said edge portion of said seat fabric.

19. The foldable chair, as recited in claim 18, wherein said seat frame further comprises a fabric-made strengthening member provided at said bottom surface of said seat fabric and connecting said two securing members for providing additional support to said seat portion of said seat fabric apart from said seat supporting bar apart from that provided by said seat supporting bar.

* * * * *